United States Patent [19]

Remington

[11] 4,444,029

[45] Apr. 24, 1984

[54] COMBINATION LOCK WITH ANTI-PICK FEATURE

[75] Inventor: Richard C. Remington, Pompton Plains, N.J.

[73] Assignee: Presto Lock, Inc., Garfield, N.J.

[21] Appl. No.: 348,717

[22] Filed: Feb. 16, 1982

[51] Int. Cl.[3] ..... E05B 37/06; E05B 63/00

[52] U.S. Cl. ..... 70/25; 70/312; 70/333 R

[58] Field of Search ..... 70/25, 26, 312, 419, 70/333

[56] References Cited

U.S. PATENT DOCUMENTS

| | | | |
|---|---|---|---|
| 3,720,082 | 3/1973 | Feinberg et al. | 70/25 |
| 3,732,711 | 5/1973 | Albert | 70/312 |
| 3,879,968 | 4/1975 | Schweizer | 70/419 |

FOREIGN PATENT DOCUMENTS

| | | | |
|---|---|---|---|
| 1281543 | 7/1972 | United Kingdom | 70/312 |

*Primary Examiner*—Robert L. Wolfe

*Attorney, Agent, or Firm*—Shapiro and Shapiro

[57] ABSTRACT

A combination padlock has dial-driven rotary sleeves mounted within the lock casing on a longer leg of the padlock shackle. The sleeves have peripheral teeth with at least one tooth being omitted on each sleeve to define a bypass gap. To open the lock, the dials must be rotated so as to turn each of the bypass gaps into alignment with a respective blocking projection in the lock casing. To thwart any attempt to pick the lock, alternate teeth on each sleeve are shorter than the adjacent teeth whereby a detent-type feel may be produced when the sleeve is rotated, simulating the feel produced when the bypass gap is brought into line with the respective blocking projection.

6 Claims, 24 Drawing Figures

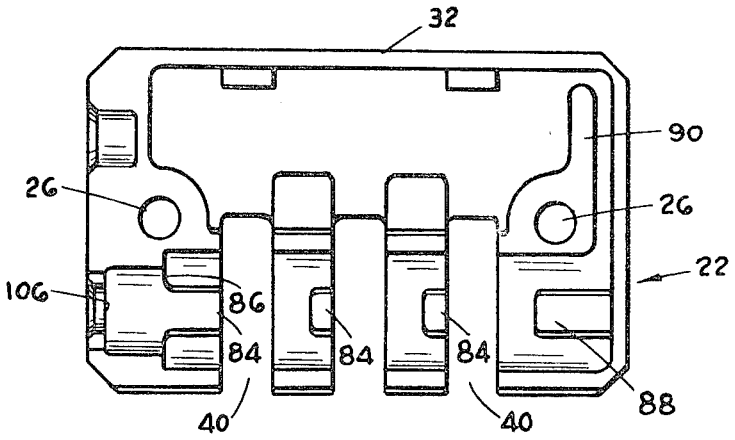
FIG. 12
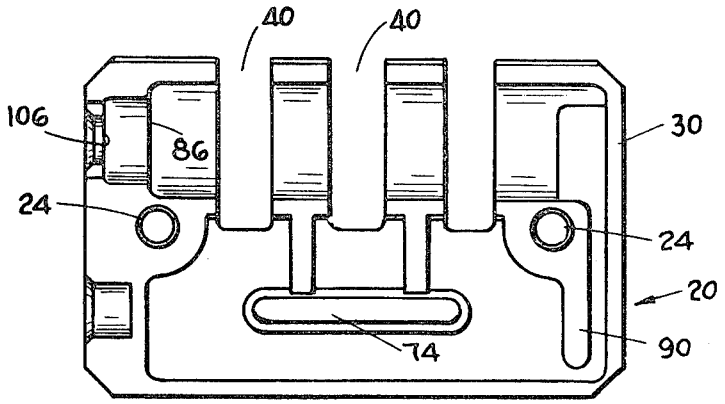
FIG. 13
FIG. 14
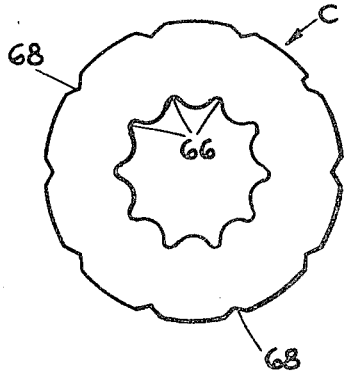
FIG. 15
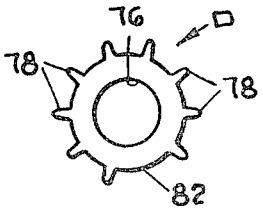
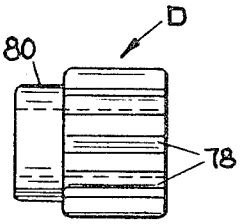
FIG. 16

COMBINATION LOCK WITH ANTI-PICK FEATURE

BACKGROUND OF THE INVENTION

This invention relates to combination locks of the type wherein a locking action is controlled by rotary elements such as sleeves with elongate peripheral teeth, one or more of which teeth is omitted on each sleeve. The teeth cooperate with blocking means which may comprise projections formed, for example, in a lock body adjacent the respective elements. The arrangement is such that when a tooth on any rotary element aligns with the respective blocking means, axial movement of the rotary elements, necessary to open the lock, is prevented; but when gaps in the rotary elements defined by the omitted teeth are brought into alignment with the blocking means, the gaps provide bypass means for the blocking means allowing the sleeves to be moved axially to open the lock.

One known lock of the above type is, for example, the padlock which is described in U.S. Pat. No.3,720,082 to Feinberg et al, issued Mar. 13, 1973. Here, the sleeves are carried in a lock casing on the longer leg of the lock shackle, and are coupled for rotation with surrounding combination dials via the peripheral teeth, which mesh with complementary teeth on the dials. When the gaps defined by the omitted teeth of the respective sleeves are brought into alignment with the blocking means, by rotation of the dials into their on-combination settings, the shackle can be drawn out of the casing to open the lock, with the sleeves moving axially in conjunction with the longer shackle leg, relative to the blocking means and relative to the dials. When, however, a tooth on any sleeve aligns with the adjacent blocking means (one or more of the dials having been moved away from the on-combination setting), outward movment of the shackle is prevented.

One problem which may arise in padlocks of the above type is that if a pulling force is applied to the shackle when it is locked, and each dial is selectively rotated, starting with the dial exhibiting the highest amount of friction, following this with the dial exhibiting the next highest amount of friction, et seq., it may in each case be possible to feel the engagement of the respective blocking means against the ends of the sleeve teeth, and also to feel in a manner akin to feeling a detent, when a gap comes into alignment with a blocking means. Thus, it may be possible to feel when each dial is brought into its on-combination setting so that it may, without prior knowledge, be possible to determine by feel the correct combination of the lock, thereby making the lock susceptible to being picked. Locks in accordance with the present invention are intended to reduce this possibility.

SUMMARY OF THE INVENTION

In accordance with one aspect of the invention, in a combination lock of the type described in the opening paragraph, at least one tooth on each sleeve has a portion removed at the end of the tooth adjacent a respective blocking means, i.e., the tooth is shorter at this end than the adjacent teeth on the sleeve. With this arrangement employed, for example, in a padlock as described above, if a pulling force is exerted on the shackle and the dials rotated in an attempt to determine the combination by feel, a false on-combination detent-type feel may be obtained when the shortened tooth is brought into alignment with a blocking means, which simulates the feel obtained when the bypass gap is brought into proper alignment.

Preferably, in order to further confuse any attempt to pick a lock in the manner previously described, the alternate teeth on each sleeve may be shortened as aforesaid. Thus, whenever a shortened tooth passes a blocking means, when the lock is manipulated as previously described, a detent-type feel may be produced suggesting that the particular dial is in its on-combination setting. It has been found to be extremely difficult, even for experienced personnel, successfully to pick a lock of this kind.

In carrying out the invention, the shortened teeth, may for example, be reduced in length by about 0.01 inches compared with the remaining teeth, in order to give the required results.

Additional features of the invention will be apparent from the foregoing description and claims taken in conjunction with the accompanying drawings.

BRIEF DESCRIPTION OF DRAWINGS

FIG. 12 is a plan view of the inner side of one of the body or casing halves;

FIG. 13 is a plan view of the other body half; FIG. 14 is a side elevational view of a dial;

FIG. 15 is an end view of a sleeve;

FIG. 16 is a side elevational view of the sleeve;

DESCRIPTION OF PRIOR ART

The lock illustrated in FIGS. 1 to 16 is a combination padlock as described in the Feinberg et al patent referred to above, and which essentially comprises a body A, a shackle B, a plurality of dials C, and a plurality of sleeves D, one for each dial. To furnish controlled rotation of the dials, resilient dial cooperable means E is related to the dials.

In the lock illustrated, the combination locking means includes three dials, designated C1, C2 and C3, and the same number of associated sleeves, D1, D2 and D3. With three dials each having 10 indicia or numbers on the circumference thereof, there are 1,000 different possible combinations available. It will be understood that any desired number of dials, and like number of sleeves, may be used to furnish the desired number of available combinations.

Figure 8:
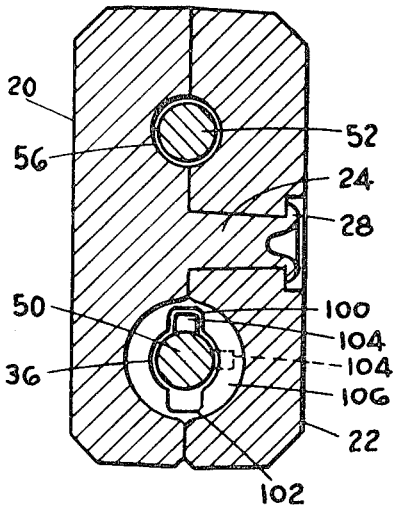
FIG. 8 is a transverse cross-sectional view taken approximately in the planes of line 8—8 of FIG. 3.
Figure 11:
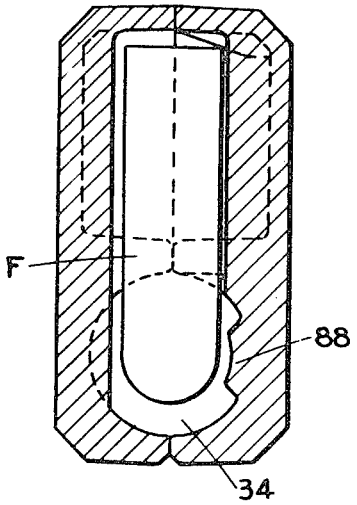
FIG. 11 is a transverse cross-sectional view taken approximately in the plane of line 11—11 of FIG. 3.

The body A comprises a pair of body members 20 and 22 suitably connected to one another. For convenience of manufacture and to minimize the number of parts, it is preferred that the body members be made by die casting. As shown in FIGS. 12 and 13, one body member is provided with a pair of integral, spaced connecting studs 24 and the other body member is made with a pair of spaced openings 26 through which the connecting studs are extended, following which the ends 28 of the studs are headed over to securely connect the parts to one another (FIG. 8). With the body members 20 and 22 connected to one another, their respective peripheral surfaces 30 and 32 are strongly pressed together. When connected, the body members provide an internal, substantially annular, longitudinally extending cavity 34. The diameter of the cavity is larger than the over-all diameter of a sleeve. The cavity is in communication with an opening 36 in one end 38 of the body A. A plurality of transverse, longitudinally spaced slots 40 is in communication with the cavity 34. The slots each have a dial C positioned therein.

Figure 2:
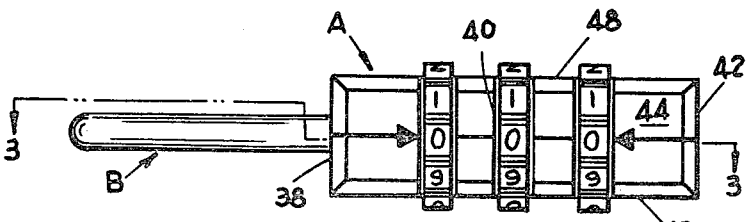
FIG. 2 is a front view of the lock.
Figure 1:
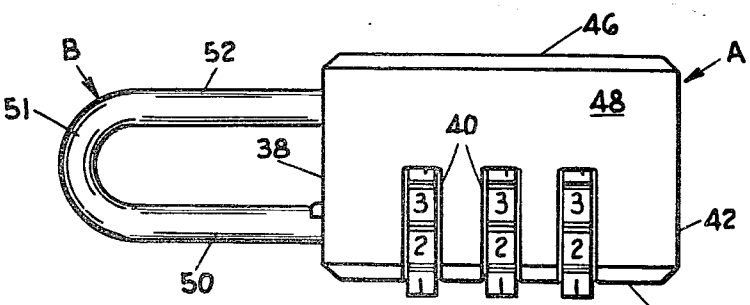
FIG. 1 is a side elevational view of a known combination padlock.
Figure 3:
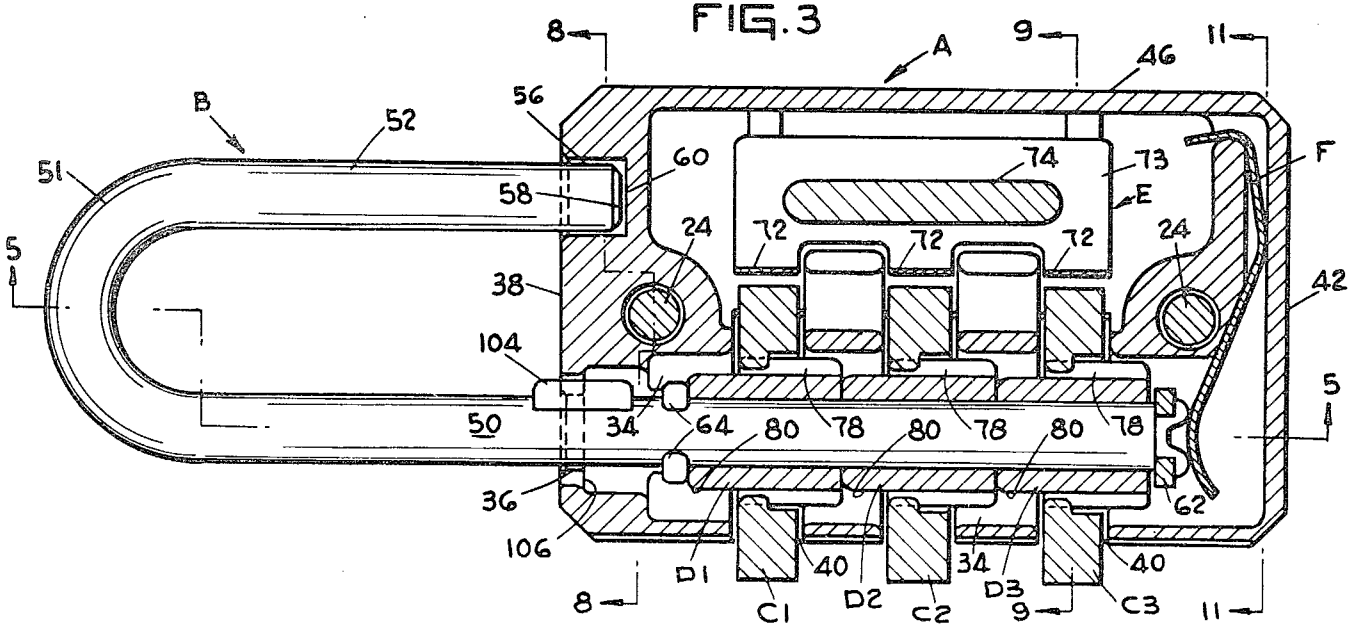
FIG. 3 is an enlarged longitudinal cross-sectional view taken approximately in the planes of lines 3—3 of FIG. 2, this view showing the shackle in closed position but with the mechanism "on combination" with the shackle in readiness to be moved to the outward or open position.
Figures 5, 7, 7A:
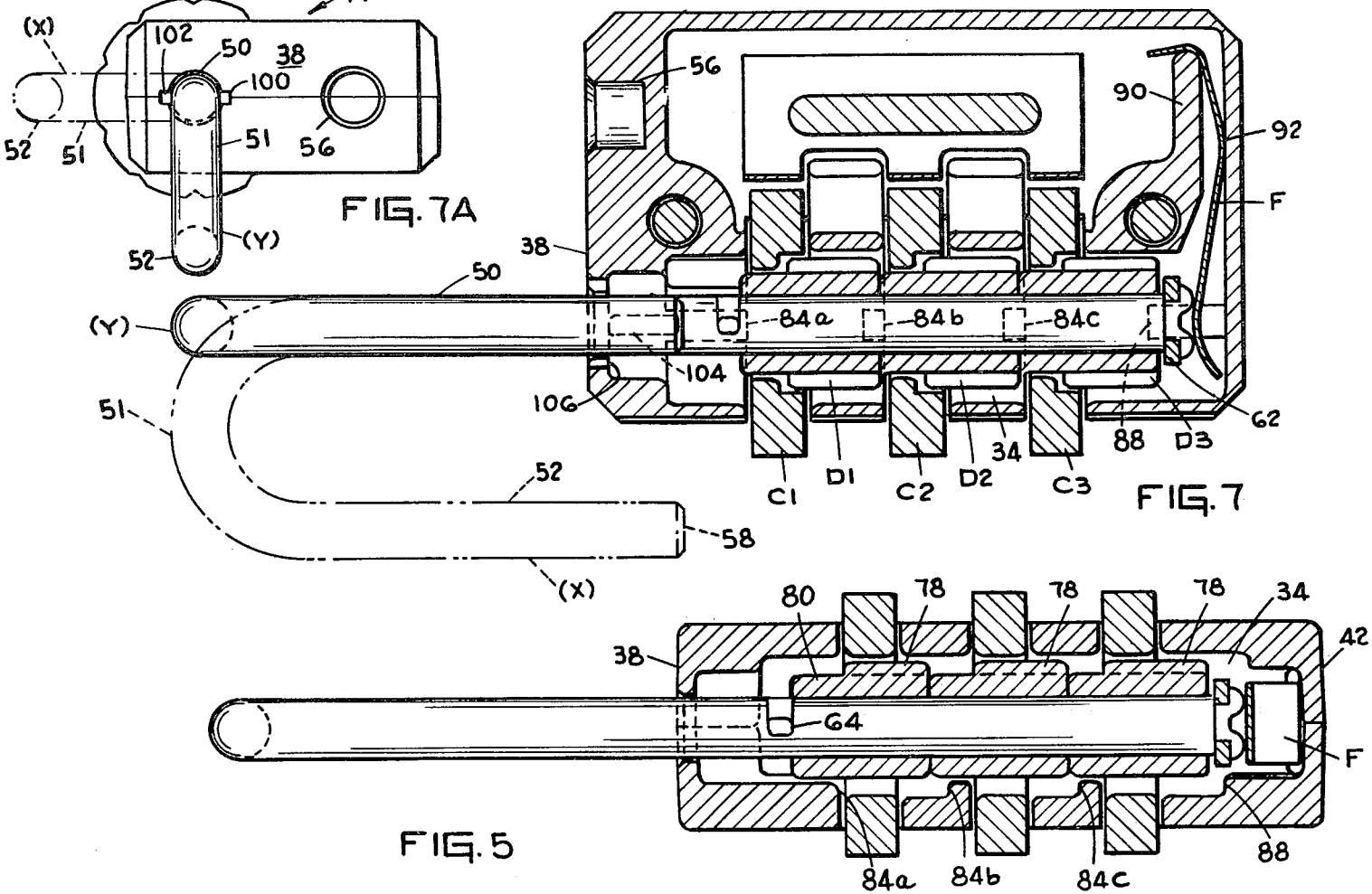
FIG. 5 is a cross-section taken approximately in the planes of lines 5—5 of FIG. 3.
FIG. 7 is a view showing the relationship of the parts when the shackle is moved to the position to change the combination.
FIG. 7A is an end view as seen from the left of FIG. 7.

Preferably, and as shown in FIGS. 1, 2 and 7A, the body A is in the form of a rectangular parallelepiped, the ends 38 and 42, the sides 44 and 46, and the sides 48 and 49 being rectangular. It will be apparent, however, that the body may have any desired outer configuration.

The shackle B has the usual J-shape, and comprises a long portion or leg 50 and a short portion or leg 52 parallel thereto. The legs are connected by a curved or bent portion 51. As shown in FIGS. 3–7, the long portion 50 extends through the opening 36 with a small amount of clearance and into the cavity 34. The body A is provided with a recess 56 to receive the end 58 of the short portion 52 when the shackle is in closed position. The base 60 of the recess serves as a stop to limit the extent that the shackle may be moved inwardly to the closed position shown in FIG. 3.

The sleeves D are mounted on the long portion 50 of the shackle in abutting, end-to-end relation. The sleeves are each provided with a central bore through which the long portion of the shackle extends with a slight amount of clearance. The sleeves are secured to the long portion of the shackle against linear movement. This may be accomplished, as shown in FIGS. 3–7, by securing a washer 62 to the free end of the long portion, as by heading over the end of the shackle against the washer, the opposite side of the washer being forced against a shoulder formed on the part. At the other end of the assembled sleeves, a pair of oppositely extending lugs 64 may be upset from the shackle to abut the edge of the adjoining sleeve D1. The shackle may be rotated with respect to the sleeves and the body. The sleeves are rotatable on the long portion of the shackle, and the sleeves move linearly with the shackle as a unit.

Figure 9:
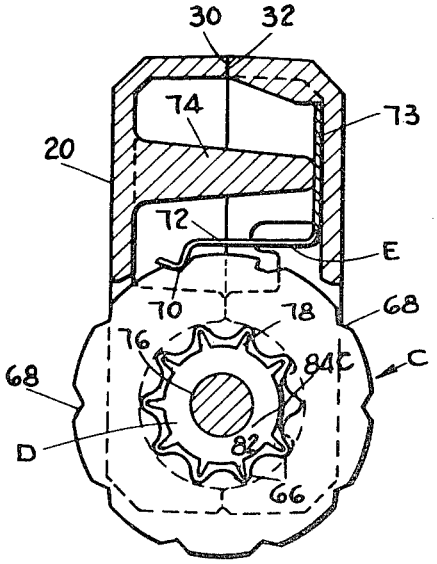
FIG. 9 is a transverse cross-sectional view taken approximately in the plane of line 9—9 of FIG. 3.
Figure 10:
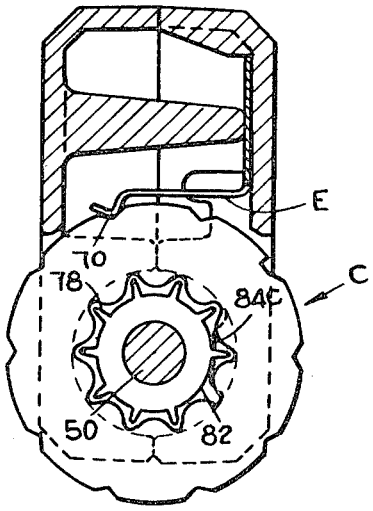
FIG. 10 is a view similar to FIG. 9, this view however, showing a dial and an associated sleeve in the "off combination" relationship of these two components.

As shown in FIG. 14, each dial C has a central opening extending therethrough, and a plurality of circumferentially spaced grooves 66 on its inner diameter, there being one groove for each number or indicia on the outer circumference of the dial. As shown in FIGS. 9 and 10, notches 68 are spaced around the outer circumference of the dial between adjacent numbers or indicia. The notches on each dial cooperate with a detent 70 on a spring arm 72 which extends from the base portion 73 of the dial cooperable means E. The dial cooperable means is stamped and formed from a metal having spring properties, and the part is made with a number of arms equal to the number of dials. The part is held in place by a holding member 74 which extends from the body member 20, the end of the projection pressing the base portion 73 against the adjoining wall of the opposite body member. This arrangement prevents the dials from spinning freely; the rotation of the dials, and the sleeves, is controlled.

The dials C and the sleeves B are provided with cooperable means to separably key them to one another. As shown in FIGS. 15 and 16, each sleeve has a central bore 76 of a diameter slightly greater than the diameter of the shackle. The outer diameter of the sleeve is provided with a plurality of circumferentially spaced, longitudinally extending teeth 78. The teeth extend longitudinally for a distance less than the length of each sleeve, whereby a shank or base portion 80 or reduced diameter is provided for a portion of the sleeve's length. For a 10 insignia or numbered dial, there are 10 grooves 66. Each sleeve, however, is provided with nine teeth. One tooth is omitted to furnish a gap constituting bypass means 82. The bypass means comprises a segment in the toothed portion, and has a diameter the same as the diameter of the shank 80.

Figure 6:
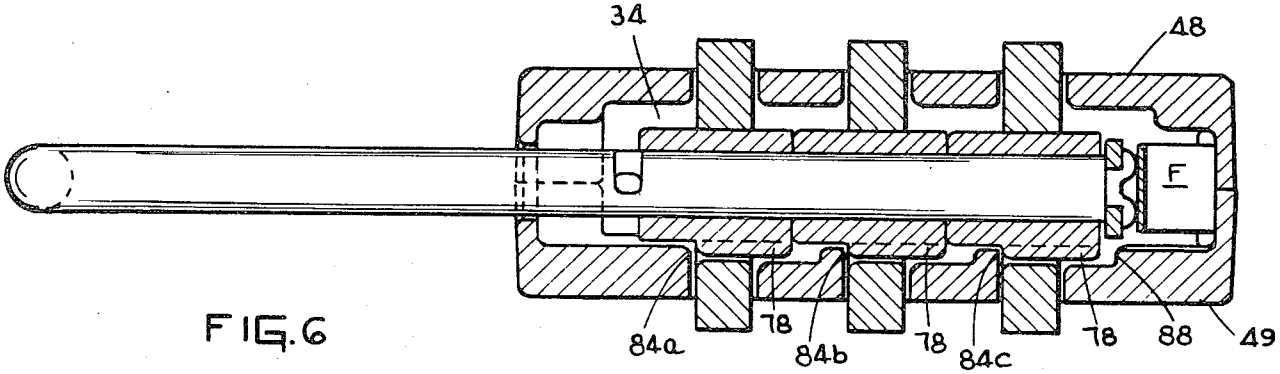
FIG. 6 is a view similar to FIG. 5, except that the mechanism is "off combination" and the device is in locked condition.

The body A is provided with means cooperable with each sleeve to prevent movement of the shackle, or to maintain the device in locked condition. For this purpose, the body is provided or cast with a plurality of longitudinally spaced blocking means in the form of projections 84*a*, 8*b* and 8*c*. The blocking projections extend into the cavity 34 for selective cooperation with the teeth 78 and with the bypass means 82. When, as shown in FIG. 6, a blocking projection is in the path of a tooth on any one of the three sleeves ("off combination"), the device is locked; that is, the shackle cannot be moved from its closed and locked position as shown in FIG. 6 to the open position as shown in FIG. 4.

When the sleeves are all oriented so that the bypass portions 82 are in alignment with the blocking projections 84, the padlock is "on combination". As a result, the shackle may be moved from the closed position of FIG. 3 to the open position of FIG. 4 and vice versa. In the open position of the shackle, the bypass portions 82 on each sleeve are astride the blocking projections 84 and the teeth are within the dial grooves 66, as shown in FIG. 9. As a result, the dials cannot be rotated. To limit the extent that the shackle may be moved in an outward direction to open position, the body A is provided with an annular shoulder 86 which is engaged by the teeth 78 of the adjoining sleeve D1, as shown in FIG. 4. As previously indicated, the shackle is limited in its inward movement to the closed position by the engagement of the end 58 of the short portion with the base 60 of the recess 56. In the movement of the shackle from the closed to open position and vice versa, or from the position of FIG. 3 to the position of FIG. 4 and vice versa, the teeth 78 on the sleeves are at all times within the grooves 66 of the dials.

Figure 4:
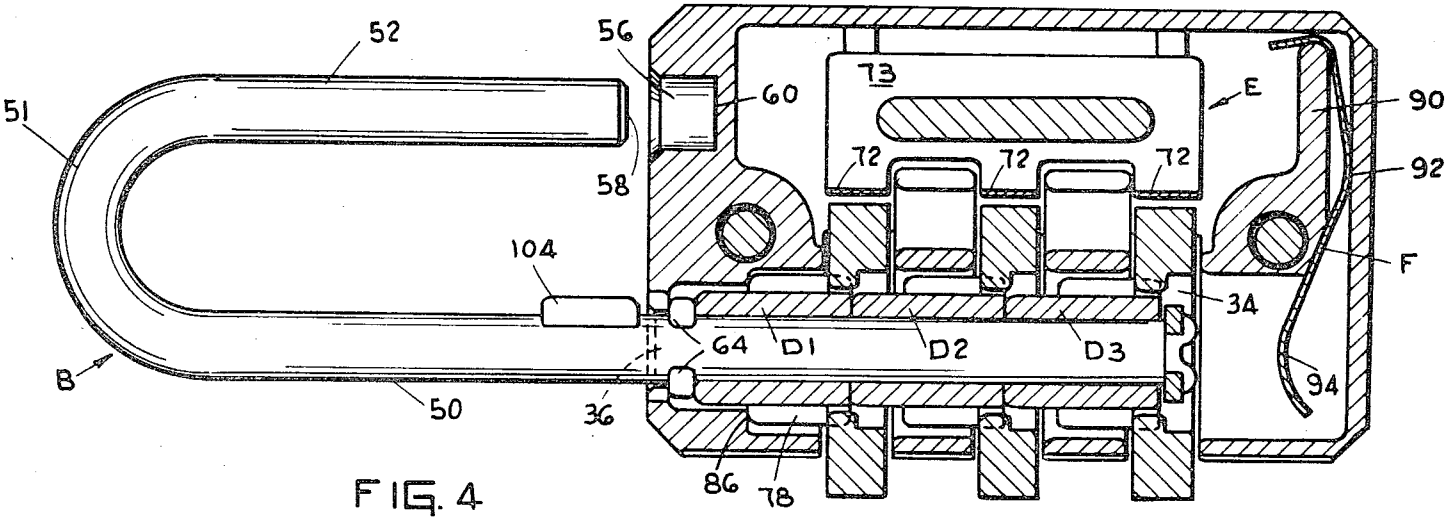
FIG. 4 is a view similar to FIG. 3, this view showing the shackle displaced to open position.

To change or set the device to a combination of one's own choice, the shackle is moved from the open position of FIG. 4 to the third or combination changing position as shown in FIG. 7. In this latter position, the teeth 78 of the sleeves are disengaged from the grooves 66 of the dials, whereby a sleeve-dial relationship may be changed to a new setting.

To enable the shackle to be pushed inwardly to the position of FIG. 7, the shackle is rotated around the axis provided by the long portion 50 to where the axis of the short portion 52 is located outside the perimeter of the adjoining end 38 of the body. Now, when manual pressure is applied to the shackle at the bent portion 51, the end 38 of the body does not obstruct the movement of the shackle, and the end 58 of the short portion 52 may move alongside and below the plane of the end 38 of the body.

In the case of a padlock having three dials, and therefore three sleeves as illustrated, an additional or fourth projection 88 is provided to extend from the body at that end of the cavity 34 which is adjacent to the closed end wall 42. The projection 88 is in alignment with the projections 84. Whereas the projections 84 function both to block movement of the shackle and to allow and guide movement of the shackle when the bypass portions 82 are aligned therewith, the projection 88 possesses only the latter function. As a result, and since the device is "on combination" when the device is to be set to a new combination, the bypass portion 82 of the sleeve D3 moves astride the projection 88. The length of the shank portion 80 and the length of the toothed portion of each sleeve are such that upon the inward displacement of the sleeves, the sleeves D1 and D2 move onto the projections **84*b* and 84*a*, respectively (FIG. 7). Since the bypass portions 82 are astride the projections 84*a*, 84*b* and 88** with a close fit, the sleeves do not rotate while the combination is being changed. The dials however, are free to rotate, thereby permitting a sleeve-dial relationship to be changed.

While not essential, it is preferred to provide resilient means to urge the sleeves into keyed engagement with the dials. As shown, a leaf spring F has one end thereof hooked about a support 90. By casting the body members 20 and 22, portions of the support may be made as integral parts of each body member. The spring member may be bent at 92 where it engages an adjoining wall portion of the body. A bent portion 94 of the spring is biased against the end of the shackle thereby urging the shackle to the left as shown in FIGS. 3, 5, 6 and 7. Biasing the shackle to the left causes the teeth 78 to be urged into the grooves 66 of the dials.

In the preferred form of lock as illustrated, means is provided to guide the shackle to its innermost position when changing or resetting the combination. Also means is provided for holding the shackle in its innermost position while the user turns the dials to a selected new combination. To accomplish these purposes and functions, the body is provided with a pair of guide notches 100 and 102 in communication with the opening 36. As best shown in FIGS. 7A and 8, the notches on the sides of the opening 36 are in alignment with the recess 56 which receives the end of the short portion 52 of the shackle. The long portion 50 of the shackle is provided with a longitudinally extending rib 104. In the movement of the shackle from the closed position of FIG. 3 to the open position of FIG. 4 and vice versa, the rib 104 rides in the notch 100. When the shackle is to be displaced inwardly to the combination changing position, the shackle is rotated 180°. Then, pressure is applied to the bent portion 51 so that the shackle is in the position (x) shown by the dot-dash lines in FIGS. 7 and 7A. The rib 104 is guided by the notch 102 as the shackle is pushed inwardly against the force of the spring F. In this position of the shackle, the teeth of the sleeves are disengaged from the grooves in the dials thereby enabling one to change the relationship of a dial and sleeve.

To releasably hold the shackle in combination changing position while freeing both hands to hold the padlock and to manipulate the dials, the shackle may be rotated to the position (y) as shown in FIGS. 7 and 7A. In this position, the rib 104 which is within the body A, is urged by the spring F against the wall portion 106 of the body which adjoins the opening 36. After setting the combination, the reverse procedure is followed. The shackle is rotated about the axis provided by the long portion 50 to where the rib 104 is in alignment with the notch 102, whereupon the spring F displaces the shackle to its outermost position. At the same time, the sleeves are keyed to the dials, and now the shackle may be rotated to the position shown in FIG. 4 preliminary to closing and locking the device.

One problem which has been found may arise with a padlock as hereinbefore described may be best understood with reference to FIG. 6 showing the shackle and sleeves in locked position.

It has been found, if an outward pulling force is applied to the shackle in this position of the lock, and the dials rotated in sequence, it may be possible to feel the frictional engagement of the respective dial teeth 78 against the respective projections 84 and to experience a detent-type feel when a respective gap or bypass means 82 comes into alignment with the respective projection. Thus it may be possible to feel when each dial reaches its on combination position, thereby making the lock susceptible to being picked. Locks in accordance with the present invention reduce this susceptibility as hereinafter described.

DESCRIPTION OF PREFERRED EMBODIMENT

FIGS. 17–23 illustrate modifications in the lock structure described with reference to the previous figures. Apart from the modifications shown in FIG. 17–23, the construction and operation of the respective locks is the same, and like references are used to denote like parts.

Basically, in accordance with the invention, to reduce the susceptibility of the previously described lock to being picked, a modification may be made in the sleeve design. This involves, for example, shortening at least one of the sleeve teeth at the end facing the respective projection 84, so that a "false" detent-type feel may be produced when the shortened tooth comes into alignment with the respective projection, if the sleeve is rotated with outside pressure applied to the shackle as previously. Preferably, alternate sleeve teeth are shortened as aforesaid so as to provide a series of detent-type actions as the sleeve is rotated, thereby further confusing any attempt to discover the lock's combination.

Figure 19:
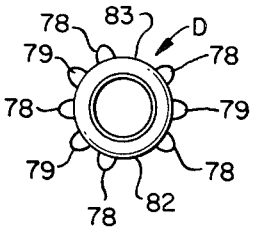
FIG. 19 is an end view of a sleeve modified in accordance with the invention.
Figure 20:
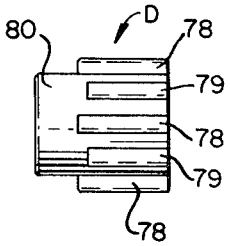
FIG. 20 is a side elevational view of the modified sleeve.

A sleeve in accordance with the invention is shown in FIGS. 19 and 20. It will be noted that this sleeve has two teeth missing, so that a pair of gaps defining respective bypass means 82 and 83 are formed. There is a group of three teeth between the gaps on one side of the sleeve axis and a group of five teeth on the other side. Further, alternate teeth 79 are shorter than the remaining teeth 78 at the ends of the teeth (the left ends of the teeth in FIG. 20) which in use face the respective blocking projections in the lock casing. In practice, for locks of the general size used in luggage hardware, for example, it has been found sufficient to make teeth 79 about 0.01 inches shorter than teeth 78 to obtain the required detent-type feel.

Figure 17:
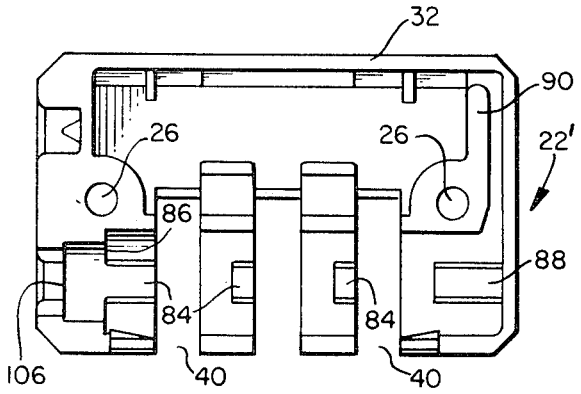
FIG. 17 is a view similar to FIG. 12, of the inner side of one body or casing half of a modified form of padlock.
Figure 18:
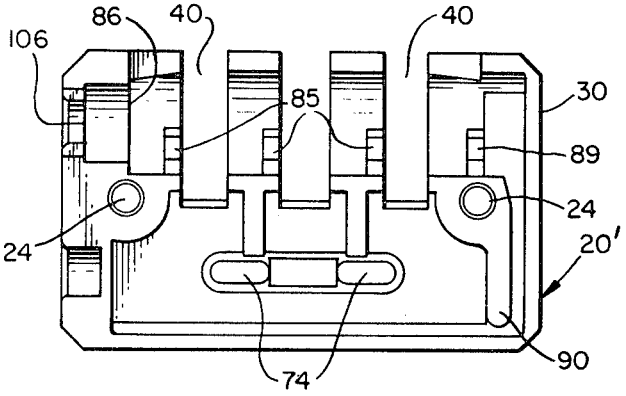
FIG. 18 is a view similar to FIG. 13 of the other body or casing half of the modified lock.

The type of sleeves shown in FIGS. 19 and 20 is intended for use in a lock casing which is provided with two sets of blocking projections, rather than the single set of such projections 84 as in the Feinberg et al patent. Thus, as shown in FIGS. 17 and 18, one of the lock casing parts 22' may be substantially similar to the equivalent part 22 in the previous construction and may include the one set of blocking projections 84, while the other casing part 20' (FIG. 18) is modified compared with the equivalent part 20 in the previous construction, by inclusion of an additional set of blocking projections 85 for the respective sleeves. The modified casing part also has an additional projection 89 corresponding to projection 88; and in this case, the holding member 74 for the dial cooperable means is divided in two.

Figure 21:
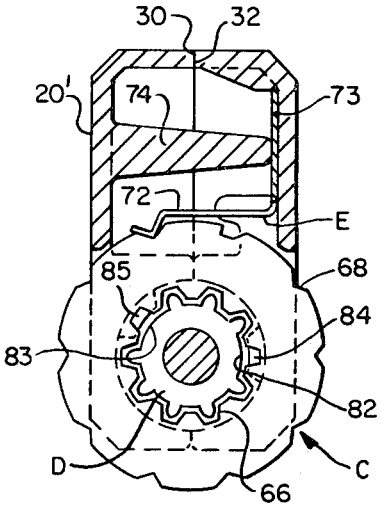
FIGS. 21 and 22 are views of the modified lock, similar to FIGS. 9 and 10.
Figure 22:
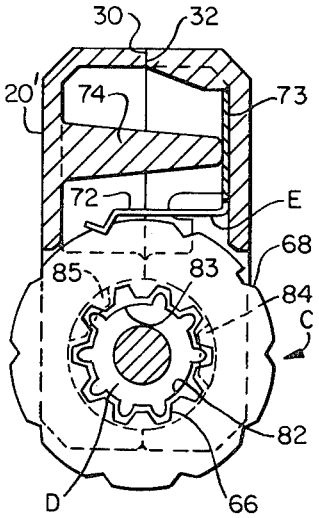
Figure 23:
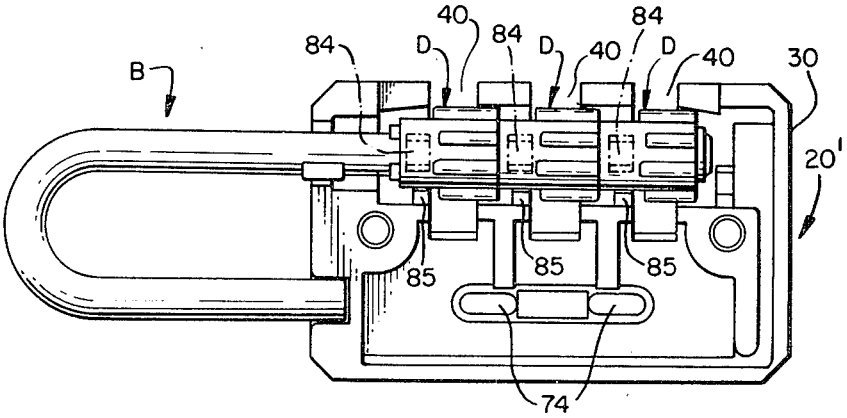
FIG. 23 is a plan view of the casing half shown in FIG. 18 with the lock shackle and sleeve assembly in place therein.

The cooperation between the dial teeth 78, 79, the bypass means 82, 83 and the blocking means 84, 85 as to the alignment and misalignment thereof is illustrated in FIGS. 21 and 22. The lengthwise relationship between the shorter and longer sleeve teeth and the respective blocking projections is shown in FIG. 23, where projections 84 are shown in phantom.

It has been found that the false detent-type feel produced by the alternating shortened teeth in accordance with the invention makes a padlock thus equipped substantially pick-proof even by experienced personnel.

By providing the second set of blocking projections on the other lock casing part, any tendency to produce a force separating the parts when applying pressure to the shackle as described, is reduced. However, the invention is equally applicable in locks with only a single set of blocking projections, and with only a single tooth omitted on each sleeve.

It will be understood that in other constructional and operational features the modified padlock may be the same as that described with reference to FIGS. 1–21.

While only a preferred embodiment of the invention has been described herein in detail, the invention is not limited thereby and modifications may be made within the scope of the attached claims. For example, the invention may be applicable in locks other than padlocks.

I claim:

1. A combination lock including rotary elements having longitudinally extending peripheral teeth, at least one tooth being omitted on each element so as to define a gap forming a bypass means between a pair of teeth, the rotary elements being disposed in axially adjacent positions and being adapted to be moved axially in unison to open the lock, blocking means for each rotary element formed in a lock body adjacent the respective rotary elements for preventing the elements from being moved axially in unison to open the lock when a tooth on at least one of the elements aligns with the respective blocking means, and for allowing the rotary elements to be moved axially in unison to open the lock when the rotary elements are turned so as to align all of said bypass means with the respective blocking means, characterized in that at least one tooth on each rotary element is shorter than an adjacent tooth at one end of the teeth adjacent the respective blocking means.

2. A combination lock as defined in claim 1, wherein alternate teeth on each rotary element are shorter than the adjacent teeth at the end aforesaid.

3. A combination lock as defined in claim 1 or claim 2, wherein a pair of teeth are omitted on each rotary element so as to define circumferentially spaced gaps forming bypass means between respective pairs of teeth, and wherein the lock includes blocking means for each element for each of the bypass means.

4. A combination lock as defined in claim 3 in the form of a padlock having a pair of mating casing parts defining a lock body, and a padlock shackle with a longer leg and a shorter leg, wherein the rotary elements comprise dial-driven sleeves mounted in the lock body on the longer shackle leg and wherein the blocking means comprise a set of blocking projections formed on one of the casing parts and another set of blocking projections formed on the other casing part.

5. A combination lock as defined in claim 3, wherein the rotary elements comprise sleeves coupled for rotation with combination dials providing ten peripheral settings for each sleeve, the teeth numbering eight on each sleeve divided into groups of 3 and 5 separated by the respective bypass means.

6. A combination lock including rotary elements having longitudinally extending peripheral teeth, at least one tooth being omitted on each element so as to define a gap forming a bypass means between a pair of teeth, the rotary elements being disposed in axially adjacent positions and being adapted to be moved axially in unison to open the lock, blocking means for each rotary element formed in a lock body adjacent the respective rotary elements for preventing the elements from being moved axially in unison to open the lock when a tooth on at least one of the elements aligns with the respective blocking means, and for allowing the rotary elements to be moved axially in unison to open the lock when the rotary elements are turned so as to align all of said bypass means with the respective blocking means, characterized in that at least one tooth on each rotary element has a configuration different from other teeth on that rotary element and defines means for providing a detent-type feel when that one tooth comes into alignment with the respective blocking means as the element is rotated with its teeth in frictional engagement against the respective blocking means.

* * * * *